United States Patent [19]

Matumoto et al.

[11] 3,962,868

[45] June 15, 1976

[54] EXHAUST GAS PURIFYING SYSTEM FOR USE IN INTERNAL COMBUSTION ENGINE

[75] Inventors: Noboru Matumoto; Takao Nonoyama, both of Toyota; Tutomu Tomita, Okazaki; Yukio Suzuki, Toyota, all of Japan

[73] Assignee: Toyota Jidosha Kogyo Kabushiki Kaisha, Japan

[22] Filed: Sept. 12, 1974

[21] Appl. No.: 505,572

[30] Foreign Application Priority Data

May 24, 1974 Japan ..... 49-57805
May 24, 1974 Japan ..... 49-57806

[52] U.S. Cl. ..... 60/278; 60/290; 123/97 B; 123/117 A; 123/119 A; 123/119 F; 123/119 R

[51] Int. Cl.[2] ..... F02M 25/06; F02B 75/10

[58] Field of Search ..... 60/278, 290; 123/117 A, 123/119 A, 119 F, 119 R, 97 B

[56] References Cited

UNITED STATES PATENTS

| | | | |
|---|---|---|---|
| 3,249,344 | 5/1966 | Smith | 123/119 F |
| 3,791,144 | 2/1974 | Lang | 60/278 |
| 3,802,402 | 4/1974 | Swatman | 123/119 A |
| 3,807,172 | 4/1974 | Masaki | 123/119 F |
| 3,812,832 | 4/1974 | Scott | 123/97 B |
| 3,818,880 | 6/1974 | Dawson | 123/119 A |

*Primary Examiner*—Douglas Hart
*Attorney, Agent, or Firm*—Kane, Dalsimer, Kane, Sullivan and Kurucz

[57] ABSTRACT

An exhaust gas purifying system for use in an internal combustion engine for controlling the air injection into an exhaust manifold and the circulation of exhaust gases from the exhaust manifold to a suction pipe, due to a negative pressure prevailing in the suction pipe, in which the negative pressure varies depending on the running conditions of the engine.

10 Claims, 5 Drawing Figures

EXHAUST GAS PURIFYING SYSTEM FOR USE IN INTERNAL COMBUSTION ENGINE

BACKGROUND OF THE INVENTION

1. Field of the invention

This invention relates to an exhaust gas purifying system for use in an internal combustion engine and more particularly to an exhaust gas purifying system of the type described which includes a catalyst convertor, an air injection means for oxidizing HC and CO by injecting air into an exhaust manifold and/or an exhaust gas re-circulating means for suppressing the generation of NO by returning part of the exhaust gases to a combustion chamber.

2. Description of the prior art

Exhaust gas test under the running conditions specified in U.S. 10 mode or 11 mode is known, by which to measure the quantity of exhausted unburnt toxic gas components contained in exhaust gases from an engine of an automobile which is typical of internal combustion engines. According to test, an automobile is driven so as to effect an idle, accelerating, constant speed and decelerating runnings, respectively, which are specified according to said mode, before and after the engine warm-up running, whereby the quantity of the toxic unburnt gas components contained in exhaust gases from an automobile during its running is measured and tested for its allowance.

Known as a countermeasure for reducing the quantity of unburnt gases from an automobile engine, i.e., so called exhaust gas countermeasures, are the one which is referred to as an engine modifying method, by which to vary, for instance, the combustion conditions of an engine and the one which is referred to as an exhaust gas post-treating method, by which to utilize chemical reactions such as oxidation and reduction for exhaust gases from cylinders of an engine or to utilize physical reactions such as filtration and adsorption of exhaust gases.

Disclosed as modifications of a suction system according to said engine modifying methods are (i) a choke opener which releases the actuation of a choke valve adapted to supply a relatively richer mixture gas to cylinders in an attempt to improve the running performances of an engine at the time of cold running, thereby rapidly providing a normal air-fuel ratio for the mixture gas to be fed, (ii) an auxiliary accelerating pump for preventing the decrease in the running performances of an engine which is caused by the operation of said choke opener, (iii) a throttle positioner for preventing the decrease in the compression ratio of a mixture gas within cylinders by preventing the rapid shifting of a throttle to its closed position at the time of deceleration and (iv) a fast idle device adapted to vary the idle opening position of a throttle valve before and after the warm-up running of an engine. In addition, known as modifications of an ignition system is a vacuum ignition advancer for controlling the ignition timing at the time of a normal running. The above-enumerated devices, in general, are operated due to a negative pressure within a suction pipe and prevent the discharge of harmful unburnt gas components by bringing the combustion of a mixture gas in cylinders to an improved condition.

Known as the measures according to the aforesaid exhaust gas post-treating method are (i) an air injection device which feeds the air from an air cleaner to an exhaust manifold to thereby cause the reaction of unburnt gas components, (ii) a catalyst convertor which causes oxidation of unburnt gas components contained in exhaust gases by using catalysts, and (iii) an exhaust gas re-circulating device which lowers a combustion temperature within cylinders by returning part of exhaust gases to a suction pipe. Said air injection device and catalyst convertor prevent the discharge of unburnt gas components such as HC and CO by resorting to the oxidation reaction, while said exhaust gas re-circulating device lowers the combustion temperature in cylinders to thereby prevent the generation of NO for purifying exhaust gases.

According to one of the conventional exhaust gas purifying systems for reducing the quantity of unburnt gases exhausted under the running condition specified in said mode below the allowance, there are provided a choke opener, a throttle positioner, a fast idle device, a vacuum ignition advancer, means for injecting air to an exhaust manifold, a catalyst convertor and an exhaust gas re-circulating device. However, since the air injection to said exhaust manifold accompanies a high temperature due to the oxidizing reaction, it is mandatory to stop the feed of air for said air injection from viewpoints of running performance, safety and protection of the catalyst convertor, at the time of high loading running as well as at the time of starting a decelerating running. This is particularly true in the decelerating phase of an engine which is likely to incur a misfire to an engine, particularly in the case of starting decelerating running of an engine which is most likely to cause a misfire. More particularly, it is imperative to stop the feed of air at the time of an high speed running which requires a high R.P.M. for an engine, at a throttle-full-open running which imposes a high load on an engine, at the time of engine brake running for a long period of time and at the time of running when an engine is subjected to a high temperature, for the purposes of preventing an afterfire as well as for preventing overheating of a catalyst convertor as well as deterioration of catalysts due to said overheating.

On the other hand, the feedback of said exhaust gases to a suction pipe by means of said exhaust gas re-circulating device will lead to the decrease in an output of an engine, because the combustion temperature is lowered. It follows from this that, at the time of high loading running, at the time of low temperature running of an engine, at throttle-valve-full-open running and at the time of decelerating running, the feedback of exhaust gases to the suction pipe should be stopped. More specifically, at the time of the throttle valve-full-open, high speed, high loading running which requires a considerably high output of an engine, and at the time of idle running at a low level of an output of an engine or at the time of low temperature running of an engine, the feedback of the exhaust gases to the suction pipe should be stopped for preventing the decrease in the output of an engine, while at the time of decelerating running, the feedback of exhaust gases should be stopped for preventing an unsatisfactory combustion condition of a mixture gas in cylinders as well as poor ignitability of a mixture gas due to the re-circulation of exhaust gases.

For those reasons, said conventional exhaust gas purifying system is provided with (i) an air switching device for feeding the air from an air cleaner to an exhaust manifold commensurate to the running condition of an engine as well as for returning air to the air cleaner, when not required, (ii) a shut-off valve for interrupting exhaust gases from being returned from the exhaust manifold to the suction pipe, and (iii) a device for actuating said shut-off valve.

With the conventional air switching device, the intelligence as to the running conditions such as a temperature at an engine which is fed from a vehicle speed sensor and the like is collected and fed to a computor for analysis, after which according to a signal from the computor, the air from an air cleaner is fed to an exhaust manifold commensurate to the running conditions or the air is returned to said air cleaner, while said shut-off valve actuating device returns exhaust gases to the suction pipe according to signals from the computor, as in said air switching device, or prevents the feedback of exhaust gases.

As is clear from the foregoing, the conventional exhaust gas purifying system dictates the provision of a computor for feeding signals so as to operate the air switching device and shut-off valve actuating device, thus resulting in a complicated construction and hence high cost. Another disadvantage is that there is a possibility of causing a vehicle fire and overheating of a catalyst convertor which is one of the causes for deterioration of catalysts due to the increasingly vigorous reaction within the catalyst convertor, which reaction is caused by the increase in the quantity of unburnt gases contained in exhaust gases, at the time of an engine-brake running for a long period of time.

SUMMARY OF THE INVENTION

It is an object of the present invention to provide an exhaust gas purifying system which is simple in construction.

It is another object of the present invention to provide an exhaust gas purifying system having a catalyst convertor which would not incur the deterioration of catalysts, even in the case of an engine-brake running for a long period of time.

According to the present invention, there is provided an exhaust gas purifying system for use in an internal combustion engine, which includes an air cleaner, a suction pipe connected to said air cleaner, a throttle valve and a choke valve provided within said suction pipe, an exhaust manifold and a catalyst convertor, said system comprising: a vacuum ignition advancer adapted to be operated due to a negative pressure; a throttle positioner; a choke opener; an auxiliary accelerating pump; a fast idle device; an air switching device provided with first and second valves; an air feedback pipe adapted to feedback the air from the air cleaner to the air cleaner through said first valve; a pipe for feeding the air from the air cleaner to the exhaust manifold through the first and second valves; a pipe for feeding air from the air cleaner to the catalyst convertor through said first and second valves; an exhaust gas feedback pipe for exhaust gases from the exhaust manifold to the suction pipe therethrough; and a shut-off valve provided in the exhaust gas feedback pipe.

The exhaust gas purifying system according to the present invention prevents the overheating in a catalyst convertor by feeding air from an air cleaner to a catalyst convertor at the time of engine-brake running for a long period of time, and is based on the discoveries that there is a considerable difference in negative pressure between the upstream side, i.e., the air cleaner side of a throttle valve within a suction pipe and the downstream side, i.e., the engine side of the throttle valve and that an opening position of the throttle valve substantially depends on the running conditions of an automobile, whereby the vacuum ignition advancer, throttle positioner, choke opener, fast idle device, first and second valves and shut-off valve are operated due to the negative pressure prevailing in the vicinity of an opening provided in a suction pipe, which negative pressure varies depending on the variation in the opening position of the throttle valve commensurate to the respective running conditions of an automobile, and whereby the operations of the above enumerated components are controlled commensurate to the running conditions of an engine, while the transmission of said negative pressure to the respective components is controlled due to a cooling water temperature of an engine. This enables to maintain the quantity of harmful exhaust gases from an internal combustion engine well below the allowance, without using a computor, regardless of whether it is before or after the warm-up running of an engine.

These and other objects and features of the present invention will be apparent from a reading of the ensuing part of the specification in conjunction with the accompanying drawings which indicate several embodiments of the present invention.

DETAILED DESCRIPTION OF THE PREFERRED EMBODIMENTS

Figure 1:
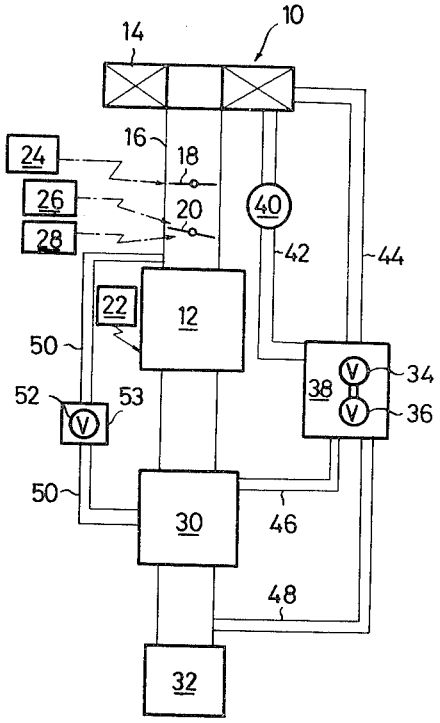
FIG. 1 is a block diagram illustrating an exhaust gas purifying system according to the present invention.
Figure 3:
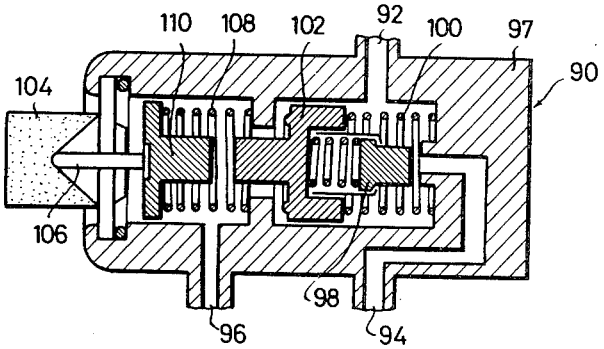
FIG. 3 is a longitudinal cross-sectional view of a warm-up sensing valve used in the exhaust gas purifying system according to the present invention.
Figure 4:
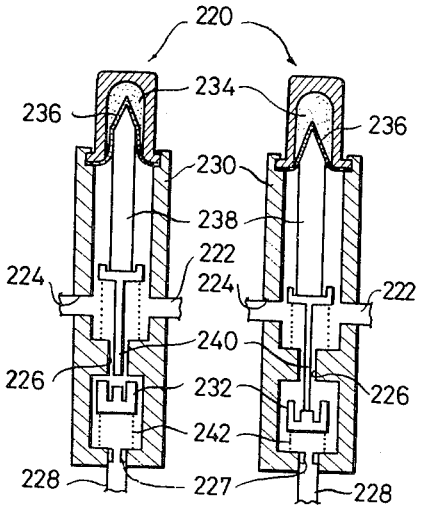
FIG. 4 is a longitudinal cross-sectional view of a thermo-wax valve used in the exhaust gas purifying system according to the present invention.

As shown in FIG. 1 which illustrates a block diagram of an exhaust gas purifying system 10 according to the present invention, the system comprises: an engine 12; an air cleaner 14 for feeding clean air to said engine 12, a suction pipe 16 for connecting the air cleaner 14 to engine 12, a choke valve 18 and a throttle valve 20 provided in the suction pipe 16; a vacuum ignition advancer 22 for controlling the ignition timing for the engine 12; a choke opener 24 for controlling opening and closing of the choke valve 18; a fast idle device 26 for controlling the idle opening position of the throttle valve 20; a throttle positioner 28 for controlling the shifting speed of the throttle valve 20 to its closed position; an exhaust manifold 30 connected to the engine 12; a catalyst convertor 32 connected to the manifold 30; an air switching device 38 having first and second valves 34 and 36; an air feed pipe 42 for feeding said air from the air cleaner 14 to the air switching device 38 through an air pump 40; an air feedback pipe 44 for returning to the air cleaner 14 through the first valve 34 the air which has been fed through the air feed pipe 42; air feed pipes 46 and 48 for feeding the air which has been fed through the pipe 42 from the air pump 40, to the exhaust manifold 30 and catalyst convertor 32 through the first and second valves 34 and 36; an exhaust gas feedback pipe 50 for returning to the suction pipe 16 part of the gases exhausted in the exhaust manifold 30; a shut-off valve 52 provided in the pipe 50 and an actuating device 53 for the valve 52; a warm-up sensing valve 90, and a thermo-wax valves 220 and 262 (FIGS. 3, 4).

Figures 2A, 2B:
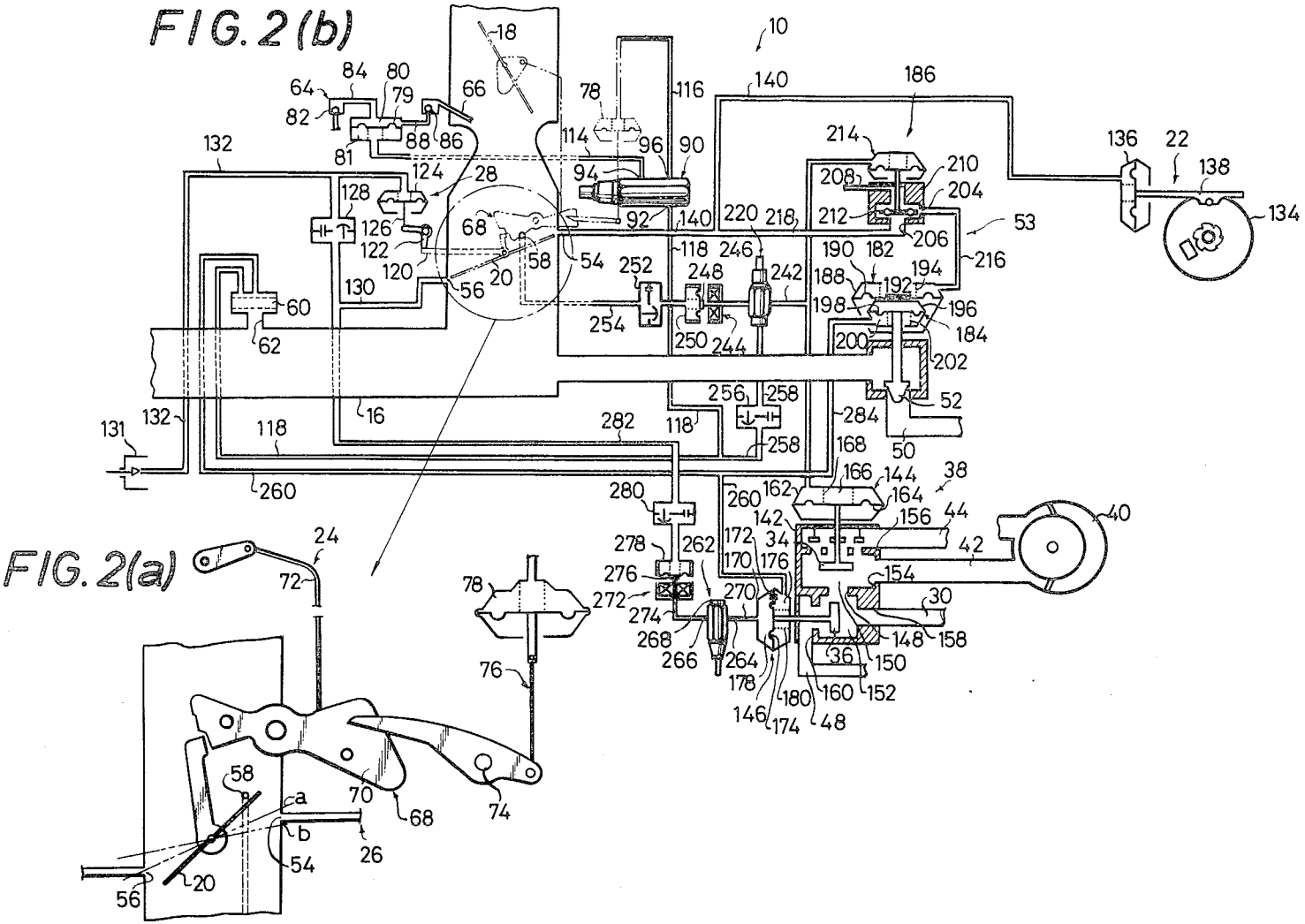
FIG. 2 is an outline showing the connecting relationship used in the exhaust gas purifying system according to the present invention.

As shown in FIGS. 2(a), (b), the suction pipe 16 is provided with: a first port 54 located between the specified throttle opening position of the throttle valve 20 shown by the line *a* and the idle opening position shown by the line *b;* a second port 56 provided in the specified throttle opening position of the throttle valve 20 shown by the line *a;* a third port 58 located on the upstream side but in the vicinity of the position of the means for attaching the throttle valve 20; and a port 62 located on the downstream side of the suction pipe 16 and provided with a filter 60 permitting the communication of only the air therethrough. The third port 58 is located in such an opening position of the throttle valve 20 when the normal running of an automobile is being shifted to a high speed running which requires to stop the air feed to the exhaust manifold 30, for the sake of the protection of the catalyst convertor 32. In addition, the suction pipe 16 is provided with a nozzle 66 for use with an auxiliary accelerating pump 64 adapted to aid in the action of a main accelerating pump (not shown), the pump 64 being adapted to cooperate with an accelerator pedal (not shown) and improving the accelerating performance of the main accelerating pump by feeding fuel into the suction pipe 16.

The choke opener 24 and fast idle device 26 are coupled by the medium of a link mechanism 68. The link mechanism 68 consists of a fast idle cam 70 adapted to vary the idle opening position of the throttle valve 20 before and after the warm-up running of an engine, a rod 72 adapted to transmit the operation of the cam 70 to the choke valve 18 and a lever 74 engaging the cam 70, the lever 74 being adapted to be operated by means of a diaphragm mechanism 78 through the medium of a link 76.

The auxiliary accelerating pump 64 is provided with: a diaphragm 79 functioning as a pump; a pump chamber 80 and a diaphragm chamber 81 provided on the opposite sides of the diaphragm 79; a pipe 84 having a check valve 82 therein, with its one end connected to the pump chamber 80 and with its the other end connected to a fuel tank (not shown), respectively said pipe 84 being adapted to feed the fuel from a fuel tank to the pump chamber 80 through the check valve 82 and a pipe 88 having a check valve 86 therein, with its one end connected to the pump chamber 80 and with its other end connected to the nozzle 66, respectively, said pipe 88 being adapted to feed the fuel fed to the pump chamber 80, to the nozzle 66 through the check valve 86.

The respective diaphragm chambers of the auxiliary accelerating pump 64 and the diaphragm mechanism 78 adapted to operate the choke opener 24 and fast idle device 26 are communicated through a warm-up sensing valve 90 to the port 62. The warm-up sensing valve 90, as shown in FIG. 3, is provided with: a casing 97 having ports 92, 94 and 96; a valve 98 for blocking the communication of the port 92 with the port 94; a valve 102 adapted to be urged by means of a spring 100 to the left, as viewed in the drawing and to block the communication of the port 92 with the port 96; a pin 106 adapted to be displaced by means of a thermo-wax 104 which varies its volume depending on temperatures; and a piston 110 adapted to transmit the movement of the pin 106 caused by the expansion of the wax 104 to the valves 98 and 102 by overcoming the forces of springs 100 and 108 whereby the port 92 may be selectively communicated with the port 94 or port 96 depending on the temperatures. The opening 94 is communicated with a diaphragm chamber in the auxiliary accelerating pump 64, while the opening 96 is communicated with a diaphragm chamber in the diaphragm mechanism 78 adapted to operate the choke opener 24 and fast idle device 26 by the medium of pipes 114 and 116, respectively, the port 92 being in communication with the port 62 through a pipe 118 and said filter 60.

The warm-up sensing valve 90 detects the temperature of a warm water heating the lower portion of the suction pipe 16 to enhance the evaporation of a mixture gas to be fed to a combustion chamber of the engine 12, while detecting the so called a riser temperature, i.e., the rising temperature of water as the warm-up running of the engine 12 proceeds, whereby in case the water temperature is relatively low, the port 62 will be brought into communication with the diaphragm chamber in the auxiliary accelerating pump 64 by communicating the port 92 with the port 94, and in case the water temperature is relatively high, the port 62 will be brought into communication with the diaphragm chamber of the diaphragm mechanism 78 adapted to operate the cam of the fast idle device 26 as well as the choke opener 24, by communicating the port 92 with the port 96.

The throttle positioner 28 consists of a link member 122 engaging an arm 120 provided on the throttle valve 20, a diaphragm mechanism 124, and a rod 126 connecting a diaphragm of the diaphragm mechanism 124 to the link member 122, while a diaphragm chamber in the diaphragm mechanism 124 is in communication with the second opening 56 through a pipe 130 which is equipped with a delay valve 128 adapted to impart resistance to uni-directional negative-pressure transmission. In addition, the pipe 130 is in communication with a pipe 132 having a valve 131 at its one end.

The vacuum ignition advancer 22 consists of a braker 134 adapted to vary the ignition timing, and a diaphragm mechanism 136 adapted to actuate the braker 134, while the diaphragm of diaphragm mechanism 136 is connected by the medium of a rod 138 to the braker 134, and a diaphragm chamber in the diaphragm mechanism 136 is communicated by way of a pipe 140 with the first opening 54.

The air switching device 38 is provided with a casing 142 and first and second diaphragm mechanisms 144 and 146 which are adapted to actuate the first and second valves 34 and 36, respectively. The casing 142 is provided with first and second partitioned chambers 150 and 152 which are partitioned by a partition wall having an opening 148 therein which permits the mutual communication for said chambers 150 and 152. Provided in the first partitioned chamber 150 are a port 154 communicating with the air feed pipe 42 and a port 156 communicating with the air feedback pipe 44, while there are provided in the second partitioned chamber 152 a port 158 communicating with the air feed pipe 46 for feeding air to the exhaust manifold 30 and a port 160 communicating with the air feed pipe 48 adapted to feed air to the catalyst convertor 32.

The first valve 34 is provided in the first partitioned chamber 150 and adapted to selectively open or close the port 148 provided in the partition wall of the casing 142 and the opening 156 communicating with the air feedback pipe 44, being actuated by said mechanism 144. On the other hand, the second valve 36 is provided in the second partitioned chamber 152 and adapted to selectively open or close the port 158 communicating with the air feed pipe 46 and the port 160 communicating with the air feed pipe 48, being actuated by said mechanism 146.

The first diaphragm mechanism 144 has a diaphragm chamber 166 defined by a casing 162 and a diaphragm 164, and a spring 168 which is adapted to function so as to cause the first valve 34 to close the port 148 provided in said partition wall. On the other hand, the second diaphragm mechanism 146 consists of a diaphragm 174 having an orifice 172 therein, and first and second diaphragm chambers 176 and 178 provided on the opposite sides of the diaphragm 174, while there is provided in the first diaphragm chamber 176 a spring 180 adapted to cause the second valve 36 to close the port 160 communicating with the air feed pipe 48 which is adapted to feed air to the catalyst convertor 32.

Means 53 for actuating the shut-off valve 52 provided in the exhaust gas feedback pipe 50 is provided with a third diaphragm mechanism 182 adapted to be operated to prevent or allow the feedback of the exhaust gases by displacing the valve 52 to a large extent, and a fourth diaphragm mechanism 184 adapted to control the amount of exhaust gases fed back by displacing the valve 52 to a small extent, in addition to an air switching device 186 adapted to control the operation of the third diaphragm mechanism 182.

The third diaphragm mechanism 182 has a diaphragm chamber 192 defined by a casing 188 and a diaphragm 190, and a spring 194 provided in said diaphragm chamber 192, which spring 194 is adapted to maintain the valve 52 in a position to interrupt the feedback of exhaust gases. A fourth diaphragm mechanism 184 has a diaphragm chamber 200, which is defined by a casing 196 secured to the diaphragm 190 of the third diaphragm mechanism 182 and a diaphragm 198, and is provided with a spring 202 which is adapted to function so as to increase the quantity of exhaust gases fed back, i.e., to move said valve 52 upwardly, as viewed in the drawing.

The aforesaid air switching device 186 consists of: a casing 210 having ports 204, 206 and 208 therein; a valve 212 provided in the casing 210 and adapted to selectively communicate the port 204 with the port 206 or port 208; and a fifth diaphragm mechanism 214 adapted to actuate the valve 212, while the port 204 communicates by way of a pipe 216 with the diaphragm chamber 192 in the third diaphragm mechanism 182, the port 206 communicates with the port 54 by way of a pipe 218 connected at its one end to the pipe 140 and the port 208 is open to atmosphere. The air switching device 186 functions so as to communicate the diaphragm chamber 192 in the third diaphragm mechanism 182 with atmosphere or the port 54 by virtue of the operation of the diaphragm mechanism 214.

The diaphragm chamber 166 in the first diaphragm mechanism 144 as well as the diaphragm chamber in the diaphragm mechanism 214 in the air switching device 186 are incommunication with the port 62 by way of the thermo-wax valve 220. As shown in FIG. 4 (*a*), (*b*), the thermo-wax valve 220 is provided with; a casing 230 having first and second openings or ports 222, 224 and a third opening or port 228 communicated through a passage 226 with said ports 222, 224 and provided with an orifice 227; a valve 232 adapted to interrupt or permit the communication of the opening 228 with said two ports 222 and 224; a wax adapted to vary its volume depending on the temperature variation; a pin 238 adapted to convert the volumetric variation of the wax into a linear motion through the medium of the diaphragm 236; a rod 240 adapted to transmit the operation of the pin 238 to the valve 232; and a spring 242 adapted to maintain the valve 232 in a position to close a passage 226. In addition, said valve 220, as shown in FIG. 4(*a*), permits the communication only between port 222 and port 224 at a lower temperature and, as shown in FIG. 4(*b*), it permits the communication among the ports 222, 224 and 228. The port 222 is communicated through a branch pipe 242 with the diaphragm chamber 166 in the first diaphragm mechanism 144 and with the diaphragm chamber in the diaphragm mechanism 214, respectively. The port 224 is in communication with a pipe 246 having a switching device 244 at its one end. The switching device 244 is provided with a valve 248 adapted to interrupt or permit the communication of the pipe 246 with atmosphere, and a diaphragm mechanism 250 adapted to actuate the valve 248, with a diaphragm chamber in the diaphragm mechanism 250 communicating with the third port 58 through the pipe 254 having a delay valve 252. The diaphragm mechanism 250 communicates the diaphragm chambers in the first and the fifth diaphragm mechanisms 144 and 214 with atmosphere by communicating the pipe 246 with the atmosphere due to a negative pressure acting on the diaphragm chamber. The port 228 is provided with a delay valve 256 and communicated with the port 62 by way of a pipe 258 connected to the pipe 118 at its one end.

The thermo-wax valve 220 functions to detect the temperature at cooling water which flows through a passage connecting the cooling water passage provided in an engine to a radiator (not shown) for radiating heat of the cooling water, the cooling water in a water outlet portion being designed so as to be allowed to flow when the temperature at the cooling water in the engine exceeds a given value, whereby the valve 220 will interrupt the communication of the diaphragm chamber 166 in the first diaphragm mechanism 144 as well as the diaphragm chamber in the fifth diaphragm mechanism 214 with the port 62, when the water temperature in the water outlet portion is low, and permits the communication between the respective diaphragm chambers in the both diaphragm mechanisms 144 and 214 with the port 62, when the temperature at the cooling water in said outlet portion exceeds a given value. The first diaphragm chamber 176 in the second diaphragm mechanism 146 is communicated by the medium of a pipe 260 through a filter 60 with the port 62 provided in the suction pipe 16. On the other hand, the second diaphragm chamber 178 is communicated with thermowax valve 262 having a construction similar to that shown in FIG. 4.

First, second and third openings or ports 264, 266 and 268 are provided in a thermo-wax valve 262. The port 268 which is adapted to be communicated with or blocked from the ports 264 and 266 is open to atmosphere. In addition, the port 262 is communicated by way of a pipe 270 with the second diaphragm chamber 178, while the port 266 is communicated with a pipe 274 having a switching device 272 at its one end. The switching device 272 is provided with a valve 276 which is adapted to permit or interrupt the communication of the pipe 274 with atmosphere, and a diaphragm mechanism 278 adapted to actuate the valve 276, while the diaphragm chamber in said diaphragm mechanism 278 is connected to the pipe 130 by the medium of a pipe 282 having a delay valve 280. The diaphragm mechanism 278 communicates the second diaphragm chamber 178 with atmosphere by communicating the pipe 274 with atmosphere, when the negative pressure acting on the diaphragm chamber in said mechanism 278 is increased.

In case the water temperature in the outlet portion is relatively low, thermo-wax valve 262 interrupts the communication of the second diaphragm chamber 178 with atmosphere, while it permits the communication of the second diaphragm chamber 178 with atmosphere, when the water temperature in the outlet portion is relatively high.

The diaphragm chamber 192 in the third diaphragm mechanism 182 is communicated with atmosphere or the port 54 according to the operation of the air switching device 186.

The diaphragm chamber 200 in the fourth diaphragm mechanism 184 is communicated through the medium of a pipe 284 connected to the pipe 260 at its one end with the port 62. When the engine starts in a cold season, the choke valve 18 is normally maintained in its closed position, while the throttle valve 20 is maintained in a fast idle opening angle which is larger than a normal idle opening angle after the warm-up, by means of the cam 70 in the fast idle device 26. For this reason, the ports 56 and 58 provided in suction pipe 16 are positioned on the upstream side of the throttle valve 20 and air is introduced therethrough from atmosphere, while the port 54 and the port 62 provided on the downstream side of the suction pipe 16 are positioned on the downstream side of the throttle valve 20 and a negative pressure at a relatively low level is introduced therethrough. On the other hand, since the water temperature in said outlet portion, i.e., the temperature at cooling water in the engine 12 is relatively low and said riser temperature is relatively low, the ports 228 and 268 in the thermo-wax valves 220 and 262 are maintained closed.

Accordingly, the vacuum ignition advancer 22 maintains the ignition timing of an engine in an optimum condition to enhance the starting performance of an engine, while a negative pressure acts on the diaphragm chamber in the diaphragm mechanism 136, which chamber is in communication with the port 54. The fast idle device 26 enhances the safety of an engine by maintaining the throttle valve 20 in the fast idle opening position and increasing the quantity of mixture gas to be fed to a combustion chamber, while the communication of the diaphragm chamber in said diaphragm mechanism 78 adapted to operate cam 70 with the port 62 is interrupted under the action of the warm-up sensing valve 90. On the other hand, the opener 24 improves the stability of an engine by increasing the concentration of a mixture gas to be fed to a combustion chamber, without rotating the choke valve 18 to its open position which has been maintained in its closed position. According to the auxiliary accelerating pump 64, fuel is introduced by way of the check valve 82 into the pump chamber 80 due to the fact that the negative pressure prevailing at the port 62 is introduced through the warm-up sensing valve 90 into the diaphragm chamber 81. The throttle positioner 28 maintains the link member 122 in a position which is not in engagement with the arm 120 provided on the throttle valve 20, while the negative pressure at port 56 acts on the diaphragm chamber in the diaphragm mechanism 124. On the other hand, the diaphragm mechanism 250 of the switching device 244, which is provided at one end of the pipe 246 which is communicated with the respective diaphragm chambers of the first and fifth diaphragm mechanisms 144 and 214, closes the pipe 246, since atmospheric pressure introduced through the port 58 acts on the diaphragm chamber in the diaphragm mechanism 250, thereby interrupting the communication of the respective diaphragm chambers in the first and fifth diaphragm mechanisms 144 and 214 with atmosphere. On the other hand, because the communication of the diaphragm chamber 166 with port 62 is interrupted and a negative pressure is not introduced into the diaphragm chamber 166, the first valve 34 is maintained in a position to close the opening in the partition wall, whereby said air switching device 38 returns to the air feedback pipe 44 the air which has been introduced by way of the air pump 40 from the air cleaner 14, regardless of the actuation of the second valve 36. Furthermore, the fifth diaphragm mechanism 214 maintains the valve 212 in a position closing the port 206 communicating with the port 54, because a negative pressure is not introduced into the diaphragm chamber in the diaphragm mechanism 214, like the diaphragm chamber 166 in the first diaphragm mechanism 144, thereby communicating the diaphragm chamber 192 in the third diaphragm mechanism 182 with atmosphere by way of the port 208. As a result, the third diaphragm mechanism 182 will shift the exhaust gas feedback valve 52 downwardly to a large extent, thereby interrupting the feedback of exhaust gas from the exhaust manifold 30 to the suction pipe 16, regardless of the operation of the fourth diaphragm mechanism 184.

The idle running of an engine, after the engine starts, increases R.P.M. of the engine, whereby a negative pressure prevailing in the vicinity of the port 62 provided on the downstream side of the suction pipe 16 is increased. If, at this time, the idle running is interrupted and the accelerating running proceeds due to the manipulation of an accel pedal, the increase in the opening angle of the throttle valve 20 will reduce the negative pressure in the vicinity of the port 62 provided in the suction pipe 16. Due to said reduction in the negative pressure, the auxiliary accelerating pump 64 will feed fuel, which has been introduced into the pump chamber 80 of the pump, through the nozzle 66 into the suction pipe 16 by way of the check valve 82, thereby temporarily increasing the concentration of a mixture gas to be fed to a combustion chamber, with the resultant smooth shifting to an accelerating running of an engine. When the riser temperature is increased due to the continuation of idle running or repeated accelerating running, the actuation of the warm-up sensing valve 90 will cause a negative pressure in the vicinity of the opening 62, which has been introduced into the diaphragm chamber 81 in the auxiliary accelerating pump 64, to be introduced into the diaphragm chamber in the diaphragm mechanism 78 adapted to operate the choke opener 24 as well as the fast idle device 26. As a result, the choke opener 24 will bring the choke valve 18 to its full open position, while the fast idle device 26 will maintain optimum the quantity of the mixture gas to be fed to the combustion chamber to prevent the production of unburnt gases, by returning the idle opening position to its normal idle opening position. On the other hand, when the opening angle of the throttle valve 20 exceeds the specified opening angle of the throttle valve due to manipulation of the accel pedal, the port 54 will be positioned on the downstream side of the throttle valve 20, while the opening 56 will be positioned on the upstream side of the throttle valve 20, with a negative pressure introduced through the port 54 and the atmospheric pressure through the port 56, respectively. The negative pressure at the port 54 will act on the diaphragm mechanism 136 of the vacuum ignition advancer 22, while the diaphragm mechanism 136 will actuate the braker 134. Accordingly, the vacuum ignition advancer 22 will maintain an optimum ignition timing commensurate to the increase or decrease in the negative pressure acting on the port 54, despite a temperature at an engine, thereby preventing discharge of unburnt gases. On the other hand, the atmospheric pressure at the port 56 will act on the diaphragm mechanism 124 of the throttle positioner 28, whereby the diaphragm mechanism 124 will return the link member 122 to a position to engage the arm 120 provided on the throttle valve 20. The link member 122 temporarily functions to stop to the specified opening position the abrupt closing movement of the throttle valve 20 to idle opening position due to manipulation of the accel pedal at the time of decelerating running. The stoppage of the throttle valve 20 in the specified throttle opening position will cause a negative pressure to act on the port 56, and then said negative pressure will be introduced into the diaphragm chamber in the diaphragm mechanism 128 due to the action of the delay valve 128, after a certain lapse of time. Due to the introduction of a negative pressure, the diaphragm mechanism 124 will shift the link member 122 to a position disengaged from the arm 120, thereby allowing shifting of the throttle valve 20 to an idle opening position. As a result, the throttle positioner 28 will prevent abrupt closing of the throttle valve 20 irrespective of the temperature at an engine, thereby in turn preventing discharge of unburnt gases, which have resulted from an insufficient compression ratio of mixture gases within a combustion chamber. The vacuum ignition advancer 22 and the throttle positioner 28 operate commensurate to the variation in an opening angle of the throttle valve 20, irrespective of the temperature at an engine, as has been described. However, before the warm-up running, that is to say, in case the water temperature in the outlet portion is relatively low, negative pressure will not be introduced into the respective diaphragm chambers of the first diaphragm mechanism 144 and the fifth diaphragm mechanism 214 under the action of the thermo-wax valve 220, irrespective of the variation in an opening angle of the throttle valve 20. For this reason, prior to the warmup running of an engine, air which has been fed from the air cleaner 14 will be returned by way of the first valve 34 to the air cleaner 14, while the feedback of exhaust gases to the suction pipe 16 will be prevented, so that overheating of a catalyst convertor 32 will be prevented, while maintaining a stable running condition for an engine.

After the warm-up running of an engine, i.e., when the water temperature in the outlet portion is increased, then the thermo-wax valve 220 will open the port 228 and bring the respective diaphragm chambers of the first diaphragm mechanism 144 and the fifth diaphragm chamber 214 into communication with the port 62. In case the valve 220 is actuated according to the temperature rise in water in the outlet portion, the riser temperature in general exceeds the operating temperature of the warm-up sensing valve 90, while the warm-up sensing valve 90 will be connected to the port 62 in the diaphragm mechanism 78 of the fast idle device 26. As a result, at the idle time after the warm-up running, the diaphragm mechanism 78 willl operate the cam 70 and shift the throttle valve 20 to the normal idle opening position. Accordingly, the ports 54 and 58 will be positioned on the upstream side of the throttle valve 20, and the air outside will be introduced through the ports 54 and 58, while the port 56 will be positioned on the downstream side of the throttle valve 20 and a negative pressure will be introduced through the port 56, and in addition, a negative pressure will be introduced through the port 62 provided on the downstream of the suction pipe 16. The atmospheric pressure through the port 58 acts on said diaphragm mechanism 250 which interrupts the communication of the pipe 246 with atmosphere, which pipe 246 is connected by way of the thermo-wax valve 220 to the diaphragm chambers of the first and fifth diaphragm mechanisms 144 and 186. On the other hand, a negative pressure through the port 56 is introduced into the diaphragm chamber of the diaphragm mechanism 278 which is adapted to open or close the pipe 274 communicating by way of the thermo-wax valve 262 with the second diaphragm chamber 178 in the second diaphragm mechanism 146. However, because of idle running, said negative pressure will not reach a level which can operate the diaphragm mechanism 278. Thus, the diaphragm mechanism 278 will remain unoperated, thereby blocking the second diaphragm chamber 178 from atmosphere.

Since a negative pressure through the port 612 is introduced into the diaphragm chambers in the first and fifth diaphragm chambers 144 and 214, respectively, the pipe 246 is blocked from atmosphere and the port 228 of the thermo-wax valve 220 is open. Due to the introduction of a negative pressure, the first diaphragm mechanism 144 causes the first valve 34 to close the port 156 connected to the air feedback pipe 44. On the other hand, the fifth diaphragm mechanism 214 closes the port 208, through which the valve 212 is open to the atmosphere and brings the diaphragm chamber 192 in the third diaphragm mechanism 182 into communication with the port 54. A negative pressure through the port 62 is introduced into the first diaphragm chamber 176 in the second diaphragm mechanism 146 as well as in the diaphragm chamber 200 in the fourth diaphragm mechanism 184.

The first diaphragm mechanism 144 maintains the first valve 34 in a position to close the port 156, while the second diaphragm mechanism 146 maintains the second valve 36 in a position to close the port 160, through which the valve 36 is communicated with the catalyst convertor 32. In this respect, although the negative pressure is introduced into the first diaphragm chamber 176 and on the other hand the second diaphragm chamber 178 is blocked from atmosphere, there will not arise the difference in negative pressure between the both diaphragm chambers 176 and 178, due to the orifice 172 provided in the diaphragm 174. As a result, the air switching device 38 will feed the air from the air feed pipe 42 through the first partitioned chamber 150 and second partitioned chamber 152 to the exhaust manifold 30.

The shut-off valve 52 is displaced downwardly to a large extent as viewed in the drawing by means of the third diaphragm mechanism 182 and thus prevents the feedback of exhaust gases to the suction pipe 16 irrespective of the operation of the fourth diaphragm mechanism 184.

In the accelerating running after the warm-up running as well as in the normal running, the throttle valve 20 is positioned between said idle opening position and the opening position, with which the port 58 is aligned. As a result, the port 56 and port 58 are positioned on the upstream side of the throttle valve 20, while the atmospheric pressure acts on the ports 56 and 58. On the other hand, the port 54 is positioned on the downstream side of the throttle valve 20, while a negative pressure acts on the port 54 as well as the port 62 provided on the downstream side of the suction pipe. Due to the atmospheric pressure acting on the port 58, the diaphragm mechanism 250 closes the pipe 246 as in the case of the idle running, while the diaphragm mechanism 278 closes the pipe 274 due to atmospheric pressure acting on the port 56, as in the case of the idle running.

Due to a negative pressure through the port 62, which is introduced into the diaphragm chamber of the fifth diaphragm mechanism 214, the mechanism 214 brings the diaphragm chamber 192 in the third diaphragm mechanism 182 into communication with the port 54, as in the case of said idle running. Accordingly, the third diaphragm mechanism 182 causes the negative pressure to be introduced through the port 54 into the diaphragm chamber 192, thereby raising the valve 52 as viewed in the drawing to permit the feedback of exhaust gases to the suction pipe 16. Commensurate to the level of a negative pressure at the port 62 which is to be introduced into the diaphragm chamber 200, i.e., the variations in R.P.M. of an engine and opening angle of the throttle valve 20, the fourth diaphragm mechanism 184 causes the upward and downward movements of the valve 52 for adjusting the quantity of exhaust gases to be fed back.

Like the aforesaid idle running, a negative pressure at the port 62 is introduced into the diaphragm chamber 166 in the first diaphragm mechanism 144, and a negative pressure at the port 62 is introduced into the first diaphragm chamber 176 in the secohd diaphragm mechanism 146, while the second diaphragm chamber 178 is blocked from atmosphere, so that the air switching device 38 feeds air from the air cleaner 14 to the exhaust manifold 30. In the accelerating phase in high speed running and constant speed running of a vehicle, the engine in general is in the condition encountered after warm-up running, and the throttle valve 20 is positioned at an opening angle larger than that aligning with the port 58. For this reason, the ports 54 and 58 are positioned on the downstream side of the throttle valve 20, while a negative pressure acts on the ports 54 and 58 like the port 62 provided on the downstream side of the suction pipe 16. On the other hand, like in the cases of the accelerating and constant speed running, the port 56 is positioned on the upstream side of the throttle valve 20. While atmospheric pressure acts on the port 56. Due to a negative pressure acting on the port 58, the diaphragm mechanism 250 causes the pipe 246 to be open to atmosphere, whereby bringing into communication with atmosphere the diaphragm chambers in the first diaphragm mechanism 144 and the fifth diaphragm mechanism 214 by way of the thermo-wax valve 220. For this reason, a negative pressure which has been fed through the port 62 into the port 228 in the thermo-wax valve 220 is neutralized by means of atmospheric pressure, and thus will not be introduced into the both diaphragm chambers. Accordingly, the first diaphragm mechanism 144 maintains the first valve 34 in a position to close the partition wall port 148. On the other hand, the fifth diaphragm mechanism 214 maintains the valve 212 in a position to close the port 206, thereby bringing the diaphragm chamber 192 in the third diaphragm mechanism 182 into communication with atmosphere. Due to the communication with atmosphere, the third diaprhagm mechanism 182 causes the valve 52 to be moved downwardly to a large extent, irrespective of the operation of the fourth diaphragm 184, thereby preventing the feedback of exhaust gases. Furthermore, according to the operation of the first diaphragm mechanism 144, the air switching device 38 returns air from the air cleaner 14 to the air cleaner 14 through the air feedback pipe 44, irrespective of the operation of the second diaphragm mechanism 146. In addition, in the high loading phase in a throttle valve full open running, an extremely low negative pressure which is close to atmospheric pressure, acts on the port 62 provided on the downstream side of the suction pipe 16. As a result, the air is introduced into the diaphragm chambers in the first diaphragm mechanism 144, which is communicated by way of thermo-wax valve 220 with the port 62, and in the fifth diaphragm mechanism 182. Accordingly, like in the case of high speed running, the third diaphragm mechanism 182 lowers shut-off valve to a large extent due to the diaphragm chamber 192 communicating with atmosphere, thereby preventing the feedback of exhaust gases irrespective of the operation of the fourth diaphragm mechanism 184, while the air switching device 38 returns air from the air cleaner 14 to the air cleaner 14, irrespective of the operation of the second diaphragm mechanism 146, due to the first diaphragm mechanism 144 maintaining the first valve 34 in a position to close the partition wall port 148.

In the decelerating running for a short time, due to the release of the accel pedal, the throttle valve 20 is stopped in specified throttle opening position shown by the line *a* by means of the throttle positioner, as in the case of decelerating running before the warm-up running of an engine, after which the throttle valve 20 is returned to the idle opening position shown by the line *b*. As a result, atmospheric pressure acts on the port 58, while a negative pressure acts on the port 56 in place of atmospheric pressure according to the variation in the opening angle of the throttle valve 20 and a relatively high negative pressure acts on the port 62 provided on the downstream side of the suction pipe 16. Due to atmospheric pressure at the port 58, the diaphragm mechanism 250 blocks from the atmosphere the diaphragm chambers in the first and fifth diaphragm mechanisms 144 and 214, respectively, by way of the thermo-wax valve 220. As a result, a negative pressure is introduced through the port 62 provided on the downstream of the suction pipe 16 into the both diaphragm chambers. Due to a negative pressure, the first diaphragm mechanism 144 maintains the first valve 34 in a position to close the port 156 communicating with the air feedback pipe 44. The fifth diaphragm mechanism 214 maintains the valve 212 in a position to close the port 208 and brings the diaphragm chamber 192 in the third diapragm mechanism 182 into communication with the port 54, on which atmospheric pressure acts.

Since a negative pressure at the port 56 is not directly introduced into the diaphragm chamber in the diaphragm mechanism 278 due to the action of the delay valve 280, the diaphragm mechanism 278 blocks the second diaphragm chamber in the second diaphragm mechanism 146 from atmosphere for a certain period of time thereafter. On the other hand, a relatively high negative pressure is introduced through the port 62 into the first diaphragm chamber 176 in the second diaphragm mechanism 146. As a result, there will arise a relatively large difference in negative pressure between the first and second diaphragm chambers 176 and 178, so that the second diaphragm mechanism 146 maintains the second valve 36 in a position to close the port communicating with the exhaust manifold 30. However, since the second diaphragm chamber 178 is blocked from atmosphere, the difference in negative pressure between the diaphragm chambers 176 and 178 is neutralized serveral seconds thereafter due to the action of the orifice provided in the diaphragm 174, so that the second valve 36 is returned to a position to close the port 160 communicating with the catalyst converter 32.

Accordingly, at the time of starting decelerating running, the air switching device 38 feeds air from the air cleaner 14 to the catalyst convertor 32 through the first and second partitioned chambers 150 and 152, and then to the exhaust manifold 30 several seconds thereafter. At the time of a decelerating running, the third diaphragm mechanism 182 maintains lowering the valve 52, irrespective of the operation of the fourth diaphragm mechanism 184 due to atmospheric pressure acting on the diaphragm chamber 192, thereby preventing the feedback of exhaust gases. On the other hand, in the decelerating running for a long period of time, since the throttle valve 20 is maintained in a position as in the decelerating running, the shut-off valve 52 is maintained in a position to prevent the feedback of exhaust gases, while the first valve 34 provided in the air switching device 38 is maintained in a position to close the port 156. On the other hand, a relatively high negative pressure acts on the first diaphragm chamber 178 in the second diaphragm mechanism 146, as in the case of the decelerating run, while the second diaphragm chamber 178 is maintained open to atmosphere. In other words, after a given time has been delayed due to the delay valve 280, a negative pressure at the port 56 acts on the diaphragm chamber in the diaphragm mechanism 278, so that the diaphragm mechanism 278 brings into communication with atmosphere the pipe 274 communicating with the second diaphragm chamber 178. As a result, a considerable difference in negative pressure arises between the first diaphragm chamber 176 and the second diaphragm chamber 178, and thus difference in negative pressure is maintained due to the resistance of the orifice 172, while the second diaphragm mechanism 146 maintains the second valve 36 in a position to close the port 158 communicating with the exhaust manifold 30.

Accordingly, in the decelerating running for a long period of time, the feedback of exhaust gases is interrupted and the air switching device 38 feeds air to the catalyst convertor 32.

In addition, at the time of overheating at an engine i.e., in case the water temperature in the outlet portion exceeds a normal cooling temperature, the thermo-wax valve 262 opens the port 268 communicating with atmosphere. As a result, the shut-off valve 52 is actuated due to the variation in the opening angle of the throttle valve 20, as in the case of the operation before the over-heating, while the first valve 34 is actuated in the same manner. However, the second diaphragm chamber 178 in the second diaphragm mechanism 146 is communicated with atmosphere through the port 268 in the thermo-wax valve 262, irrespective of the operation of the diaphragm mechanism 278 communicating with the port 56. Since a negative pressure at the port 62 is introduced into the first diaphragm chamber 176, except when the throttle valve 20 is in its full open position, the second valve 36 is maintained in a position to close the port 158 communicating with the exhaust manifold 30, as in the case of the decelerating running for a long period of time, while air which has been fed through the first and second partitioned chambers 150 and 152 from the air cleaner 14 is all fed to the catalyst convertor 32 for cooling catalysts.

According to the present invention, even prior to the warm-up running of an engine, the toxic components contained in exhaust gases may be reduced in quantity, without impairing the running performance, and the air feed for injection into the exhaust manifold and the re-circulation of exhaust gases may be controlled commensurate to the running conditions of an engine, without using a computor. In addition to this, the deterioration of catalysts due to the overheating and engine brake running for a long period of time may be prevented, and the quantity of toxic components contained in exhaust gases from an engine operating in accordance with the U.S. 10 mode or 11 mode may be reduced.

What is claimed is:

1. An exhaust gas purifying system for use in an internal combustion engine, which is provided with an air cleaner, a suction pipe connected to said air cleaner, a choke valve and a throttle valve provided in said suction pipe and means for attaching the throttle valve for movement within the suction pipe, an exhaust manifold and a catalyst converter connected to said manifold, the throttle valve having an idle opening position at which the throttle valve is substantially closed and the engine is in the condition of normal idle running, the throttle valve also having a throttle opening position wherein the throttle valve is substantially open, comprising:

a first port provided between the idle opening position of said throttle valve in said suction pipe and the throttle opening position;

a second port provided in said throttle opening position of said throttle valve in said suction pipe;

a third port provided on the upstream side but in the vicinity of means for attaching the throttle valve in said suction pipe;

a vacuum ignition advancer adapted to be operated due to a negative pressure introduced through said first port;

a throttle positioner adapted to be operated due to negative pressure introduced through said second port for temporarily preventing the throttle valve from assuming the idle opening position;

a choke opener adapted to be operated due to a negative pressure on the downstream side of said suction pipe and a fast idle device;

means for introducing the negative pressure prevailing on the downstream side of said suction pipe, to said choke opener and said fast idle device;

means for controlling the introduction of the negative pressure to the fast idle device according to the temperature at said internal combustion engine;

an air switching device provided with first and second valves;

an air feed pipe connecting said air switching device to said air cleaner;

a pipe for feeding back air from said air cleaner through said first valve to said air cleaner therethrough;

a pipe for feeding air from said air cleaner by way of said first and second valves to said exhaust manifold therethrough;

a pipe for feeding air from said air cleaner by way of said first and second valves to said catalyst convertor;

a first diaphragm mechanism for actuating said first valve;

a second diaphragm mechanism provided with a diaphragm having an orifice therein, and first and second diaphragm chambers positioned on the opposite sides of said diaphragm;

means for introducing a negative pressure prevailing on the downstream side of said suction pipe to the diaphragm chamber in said first diaphragm mechanism;

means for controlling the introduction of a negative pressure to said diaphragm chamber in said first diaphragm mechanism according to the negative pressure fed through said third port as well as to the temperature of said internal valves;

an air feed pipe connecting said air switching device to said air cleaner;

a pipe for feeding back air from said air cleaner through said first valve to said air cleaner therethrough;

a pipe for feeding air from said air cleaner by way of said first and second valves to said exhaust manifold therethrough;

a pipe for feeding air from said air cleaner by way of said first and second valves to said catalyst convertor;

a first diaphragm mechanism for actuating said first valve.

a second diaphragm mechanism provided with a diaphragm having an orifice therein, and first and second diaphragm chambers positioned on the opposite sides of said diaphragm;

means for introducing a negative pressure prevailing on the downstream side of said suction pipe to the diaphragm chamber in said first diaphragm mechanism;

means for controlling the introduction of a negative pressure to said diaphragm chamber in said first diaphragm mechanism according to the negative pressure fed through said third port as well as to the temperature of said internal combustion engine;

means for controlling the pressure in the second diaphragm chamber in said second diaphragm mechanism according to the negative pressure introduced through said second opening as well as to the temperature at said internal combustion engine; and means for introducing a negative pressure prevailing on the downstream side of said suction pipe to said first diaphragm chamber in said second diaphragm mechanism.

2. An exhaust gas purifying system for use in an internal combustion engine, as set forth in claim 1, wherein said system further comprises:

an exhaust gas feedback pipe for returning exhaust gases from said exhaust gas manifold to said suction pipe;

a shut-off valve for opening and closing said feedback pipe;

a third diaphragm mechanism for actuating said shut-off valve;

a fourth diaphragm mechanism having a casing affixed to a diaphragm of said third diaphragm mechanism;

a fifth diaphragm mechanism for selectively communicating the diaphragm chamber in said third diaphragm mechanism with said first port and atmosphere;

means for introducing a negative pressure prevailing on the downstream side of said suction pipe to the diaphragm chamber of said fifth diaphragm mechanism;

means for controlling the introduction of the negative pressure to said diaphragm chamber according to the negative pressure introduced through said third port as well as to the temperature at said internal combustion engine; and means for introducing a negative pressure prevailing on the downstream side of said suction pipe to the diaphragm chamber in said fourth diaphragm mechanism.

3. An exhaust gas purifying system for use in an internal combustion engine, as set forth in claim 1, wherein said system comprises:

an auxiliary accelerating pump adapted to be actuated due to a negative pressure and to feed a subsidiary fuel to said suction pipe at the time of acceleration;

means for introducing a negative pressure prevailing on the downstream side of said suction pipe; and means for controlling the above-referred introduction of the negative pressure to said pump according to the temperature at said internal combustion engine.

4. An exhaust gas purifying system for use in an internal combustion engine as set forth in claim 1, wherein means for controlling the introduction of the negative pressure into said choke opener and said fast idle device is a warm up sensing valve including a port connected to said choke valve and fast idle device and a port communicating with the downstream side of the suction pipe, a valve located within said casing and for interrupting or permitting the communication of said two ports, and wax which is adapted to vary its volume commensurate to the variation in temperature at said internal combustion engine.

5. An exhaust gas purifying system for use in an internal combustion engine as set forth in claim 1, wherein means for controlling the introduction of the negative pressure to the diaphragm chamber in said first diaphragm mechanism according to the negative pressure, which has been introduced through said third port, as well as to the temperature at said internal combustion engine consists of: a casing having a first opening communicating with the diaphragm chamber in said first diaphragm mechanism, a second opening normally communicating with said first opening and a third opening communicating with said first and second openings and with the downstream side of said suction pipe by way of a pipe having a delay valve therein; a thermo-wax valve provided with a valve for interrupting or permitting the communication of said two ports, which normally communicates with each other and positioned within said casing, with said third opening, said thermo-wax valve being further provided with wax which is adapted to vary its volume due to the temperature variation of said internal combustion engine so as to actuate said valve; and a diaphragm mechanism having a diaphragm provided with a valve for opening and closing said second opening communicating with said first opening, said diaphragm mechanism having a diaphragm chamber communicated with said third port by way of a pipe having an orifice.

6. An exhaust gas purifying system for use in an internal combustion engine as set forth in claim 1, wherein means for controlling the pressure in said second diaphragm chamber in said second diaphragm mechanism according to a negative pressure which has been fed through said second port and to the temperature at said internal combustion engine consists of: a casing having a first opening communicating with said second diaphragm chamber, a second opening normally communicating with said first opening, and a third opening communicating with said first and second openings and open to atmosphere; a thermo-wax valve provided with a valve for interrupting or permitting the communication of said first and second openings, with said third opening, and wax which is adapted to vary its volume according to the temperature variation of said internal combustion engine so as to actuate said valve; and a diaphragm mechanism having a diaphragm provided with a valve for opening and closing said first opening, said diaphragm mechanism further having a diaphragm chamber communicated with said second port by way of a pipe having an orifice.

7. An exhaust gas purifying system for use in an internal combustion engine, which is provided with an air cleaner, a suction pipe connected to said air cleaner, a choke valve and a throttle valve which is provided within said suction pipe and means for attaching the throttle valve for movement within the suction pipe, an exhaust manifold and a catalyst converter connected to said manifold, the throttle valve having an idle opening position at which the throttle valve is substantially closed and the engine is in the condition of normal idle running, the throttle valve also having a throttle opening position wherein the throttle valve is substantially open, comprising:

a first port provided between the idle opening position of said suction pipe and the throttle opening position;

a second port provided in said throttle opening position;

a third port provided on the upstream side but in the vicinity of the attaching means of said throttle valve;

a vacuum ignition advancer adapted to be operated due to the negative pressure through said first port;

a throttle positioner adapted to be operated due to the negative pressure which has been fed through said second port for temporarily preventing the throttle valve from assuming the idle opening position;

a choke opener and a fast idle device which are operated due to the negative pressure on the downstream side of said suction pipe;

means for introducing a negative pressure on the downstream side of said suction pipe to said choke opener and said fast idle device;

means for controlling the introduction of a negative pressure to said choke opener and said fast idle device according to the temperature at said internal combustion engine;

an exhaust gas feedback pipe for returning exhaust gases from said exhaust manifold to said suction pipe;

a shut-off valve for opening and closing said feedback pipe;

a third diaphragm mechanism for actuating said shut-off valve;

a fourth diaphragm mechanism having a casing affixed to the diaphragm of said third diaphragm mechanism;

a fifth diaphragm mechanism for selectively communicating the diaphragm chamber in said third diaphragm mechanism with said first opening and atmosphere;

means for introducing a negative pressure on the downstream side of said suction pipe to the diaphragm chamber in said fifth diaphragm mechanism;

means for controlling the introduction of the negative pressure to said diaphragm chamber of said fifth diaphragm mechanism according to the negative pressure fed through said third port and to the temperature at said internal combustion engine; and means for introducing a negative pressure on the downstream side said suction pipe to the diaphragm chamber in said fourth diaphragm mechanism.

8. An exhaust gas purifying system as set forth in claim 7, wherein said system further comprises: an auxiliary accelerating pump adapted to be operated due to a negative pressure for feeding subsidiary fuel to said suction pipe; means for introducing a negative pressure on the downstream side of said suction pipe to said pump; and means for controlling the introduction of said negative pressure to said pump according to the temperature at said internal combustion engine.

9. An exhaust gas purifying system for use in an internal combustion engine as set forth in claim 7, wherein means for controlling the introduction of the negative pressure into said choke opener and said fast idle device is a warm-up sensing valve including a port connected to said choke valve and said fast idle device and a port communicating with the downstream side of the suction pipe, a valve located within said casing and for interrupting and permitting the communication of said two ports, and wax which is adapted to vary its volume commensurate to the variation in temperature at said internal combustion engine.

10. An exhaust gas purifying system for use in an internal combustion engine as set forth in claim 7, wherein means for controlling the introduction of the negative pressure into said fifth diaphragm chamber according to the negative pressure fed through said third port and to the temperature at said internal combustion engine consists of: a casing having a first opening communicating with the diaphragm chamber in said fifth diaphragm mechanism, a second opening normally communicating with said first opening and a third opening communicating with said first and second openings and with the downstream side of said suction pipe by way of a pipe having a delay valve; a thermo-wax valve provided with a valve for interrupting and permitting the communication of said first and second openings with said third opening, said thermo-valve being further provided with wax which is adapted to vary its volume commensurate to the temperature variation of said internal combustion engine so as to actuate said valve; and a diaphragm mechanism having a diaphragm provided with a valve for opening and closing said second opening, said diaphragm mechanism having a diaphragm chamber in communication with said third port by way of a pipe having an orifice.

* * * * *